United States Patent [19]

Hayes

[11] 4,258,882

[45] Mar. 31, 1981

[54] SPRINKLER WITH IMPROVED TWO-PIECE ADJUSTABLE DIAL MECHANISM

[75] Inventor: Jerry R. Hayes, Peoria, Ill.

[73] Assignee: L. R. Nelson Corporation, Peoria, Ill.

[21] Appl. No.: 96,651

[22] Filed: Nov. 23, 1979

[51] Int. Cl.[3] ..... B05B 3/16

[52] U.S. Cl. ..... 239/73; 239/242

[58] Field of Search ..... 239/242, 71, 73

[56] References Cited

U.S. PATENT DOCUMENTS

| | | | |
|---|---|---|---|
| 2,921,474 | 1/1960 | Ballard | 239/242 X |
| 2,932,457 | 4/1960 | Ballard | 239/242 |
| 2,945,388 | 7/1960 | Nelson | 239/242 X |
| 3,063,646 | 11/1962 | Ballard | 239/242 |

*Primary Examiner*—Andres Kashnikow

*Attorney, Agent, or Firm*—Cushman, Darby & Cushman

[57] ABSTRACT

A two-piece adjustable dial assembly between a link and a water discharge tube of a sprinkler for causing the rotational movement of the water driven shaft of the sprinkler to be transmitted through the link to the water discharge tube in any selected one of a plurality of different oscillatory cycles of movement. The two-piece adjustable dial assembly includes an arm member molded of plastic material having a mounting portion fixedly secured to the water discharge tube and a cylindrical portion having an axis disposed parallel to the oscillatory axis of said water discharge tube, and a dial member molded of plastic material extending through the cylindrical portion of the arm member and rotatable with respect thereto about the axis thereof. The dial member has a knob portion manually engageable to effect rotation of the dial member, a pivotal connection with the other end of the link and an elongated resilient cantilevered latching portion formed integrally with the dial member. The cylindrical portion has notched surfaces receiving the free end of the resilient latching portion for yieldingly retaining the dial member in any selected one of a plurality of positions of rotational movement corresponding to the selected oscillatory cycle of movement.

10 Claims, 6 Drawing Figures

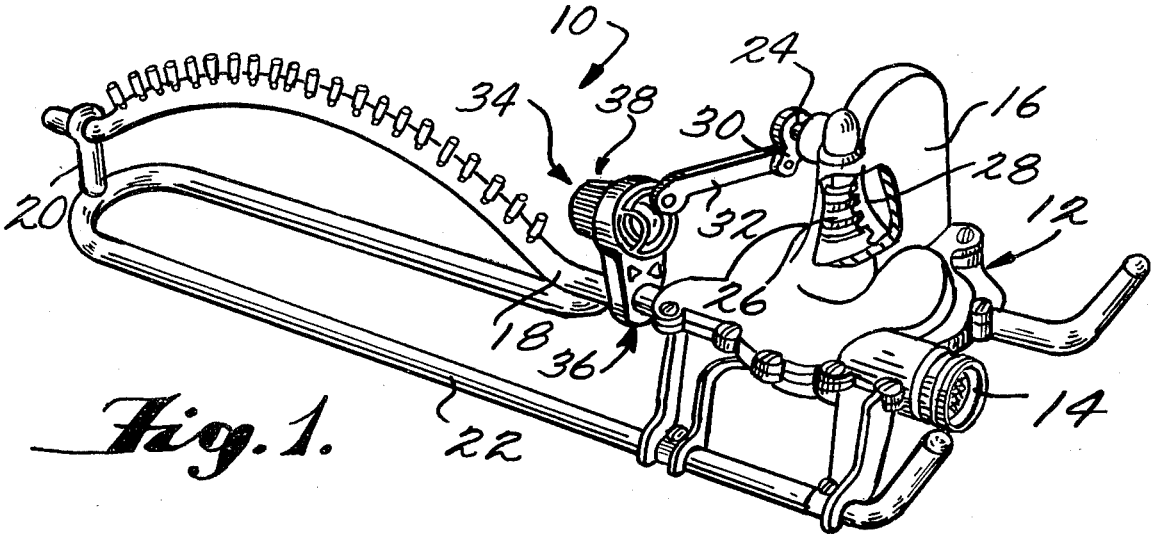
Fig. 1.
Fig. 3.
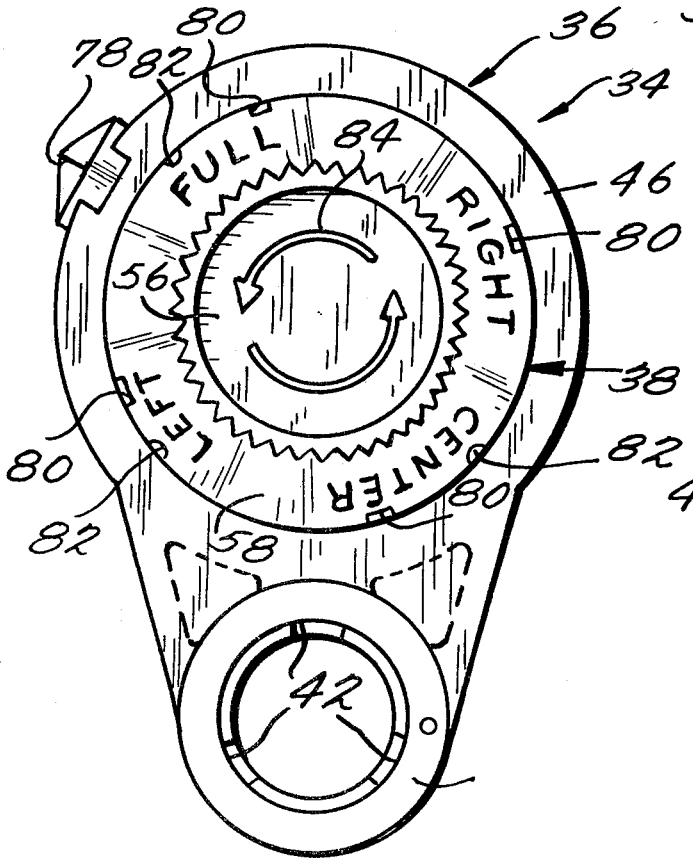
Fig. 2.
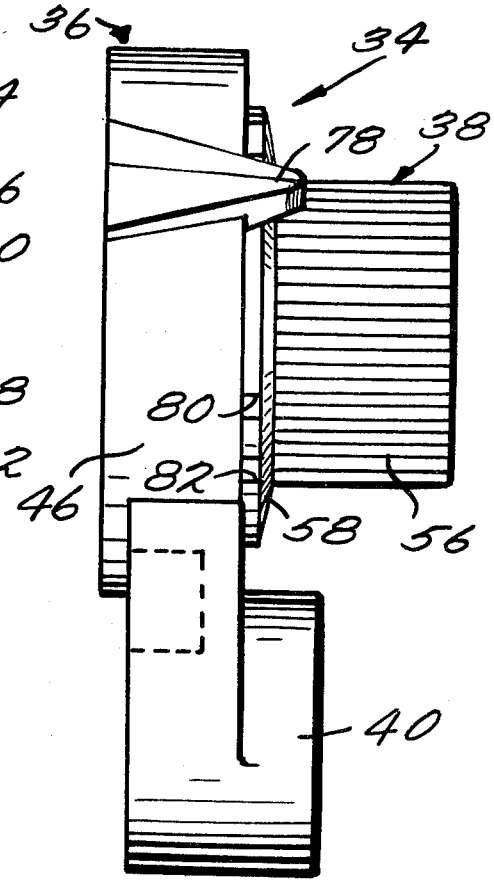

SPRINKLER WITH IMPROVED TWO-PIECE ADJUSTABLE DIAL MECHANISM

This invention relates to water sprinklers and more particularly to improvements in water sprinklers of the oscillatory type.

Oscillatory or wave-type sprinklers are well known and have received widespread commercial acceptance. Examples of sprinklers of this type are disclosed in commonly-assigned U.S. Pat. Nos. 2,921,474; 2,932,457; and 2,945,385. Characteristically these sprinklers include a housing assembly having a water inlet adapted to be connected with a source of water under pressure. A water discharge tube usually provided with an upwardly arcuate central portion is mounted in the housing assembly for oscillatory movement about a generally horizontally extending axis and in water pressure communicating relation to the water inlet. The sprinkler also includes a shaft which extends outwardly from the main housing with its axis in parallel relation with the oscillatory axis of the water discharge tube. Means is provided within the main housing for rotating the shaft in response to the flow of water under pressure from the water inlet to the water discharge tube. The shaft has one end of a link connected in motion transmitting relation to it and an adjustable dial assembly is connected between the link and the water discharge tube to cause the rotational movement of the shaft to be transmitted through the arm and link to the water discharge tube in any selected one of a plurality of different oscillatory cycles of movement. For example, in the aforesaid patents the adjustable dial assembly is capable of achieving four different oscillatory cycles which are identified by the words "center", "right", "full" and "left".

Over the years, the adjustable dial assemblies which have been utilized have, generally speaking, either been somewhat too costly or somewhat ineffective in operation. It is an object of the present invention to provide an improved adjustable dial assembly in an oscillatory sprinkler of the type described which is both effective in operation and economical in cost. In accordance with the principles of the present invention this objective is achieved by forming the adjustable dial of two pieces, each of which is molded of a plastic material as, for example, Delrin ® or Celcon ®. One of the pieces is in the form of an arm member having a mounting portion fixedly secured to the water discharge tube and a cylindrical portion having an axis disposed parallel to the oscillatory axis of the water discharge tube. The other piece is in the form of a dial member which extends through the cylindrical portion of the arm member and is rotatable with respect thereto about the axis thereof. The dial member has a knob portion at one side of the cylindrical portion of the arm member which is adapted to be manually engaged so as to enable an operator to effect rotation of the dial member with respect to the arm member. The dial member also includes a pivotal connection with the adjacent end of the motion transmitting link at the other side of the cylindrical portion.

The dial member includes an elongated resilient cantilevered latching portion which is formed integrally with the dial member at one end thereof and has its other end spaced from the integrally formed one end of a substantial arcuate distance. The cylindrical portion of the arm member is provided with a notched annular surface which receives the other end of the resilient latching portion and functions to yieldingly retain the dial member in any selected one of a plurality of positions of rotational movement corresponding to the selected oscillatory cycle of movement.

Preferably, the notched surface which receives the other end of the resilient latching portion of the dial member includes a number of notches in excess of the conventional four cycles of movement usually selected. The members are formed with indicia enabling the operator to visually observe when the dial member has been moved into one of the notches which corresponds with the selected oscillatory cycle of movement. The intermediate notches serve to provide the operator with a clicking sound which demonstrates to the operator that he should continue to turn the knob until a selected position of movement has been achieved. It is important to note that the two pieces of the dial assembly are capable of being snapped into operative relationship with respect to one another and when so related of providing the resilient or yieldable latching of the dial member into its selected position. It is important that the resilient cantilevered latching member be of substantial arcuate extent so as to provide for a fairly extensive deflection thereof, during the turning of the dial member. This insures proper operation even after extensive wear has occurred. In the preferred embodiment, the yielding of the cantilevered latching portion is in a radialy inward direction and the cantilevered portion extends generally circumferentially with respect to the dial member itself.

Preferably, the engagement of the free end of the cantilevered latching portion within a notch of the arm member is at a position diametrically opposed to the pivotal connection of the dial member with the link. This arrangement provides for interchangeable use with existing adjustable dial assemblies.

Accordingly, a further object of the present invention is the provision of an improved two-piece dial assembly in an oscillatory sprinkler of the type described which is both economical and effective and capable of extended use.

These and other objects of the present invention will become more apparent during the course of the following detailed description and appended claims.

The invention may best be understood with reference to the accompanying drawings wherein an illustrative embodiment is shown.

In the drawings:

FIG. 1 is a perspective view, partly broken away, of an oscillatory sprinkler embodying the principles of the present invention;

FIG. 2 is a side elevational view of the improved adjustable dial assembly of the present invention;

FIG. 3 is a front elevational view of the improved adjustable dial assembly of the present invention;

Figure 5:
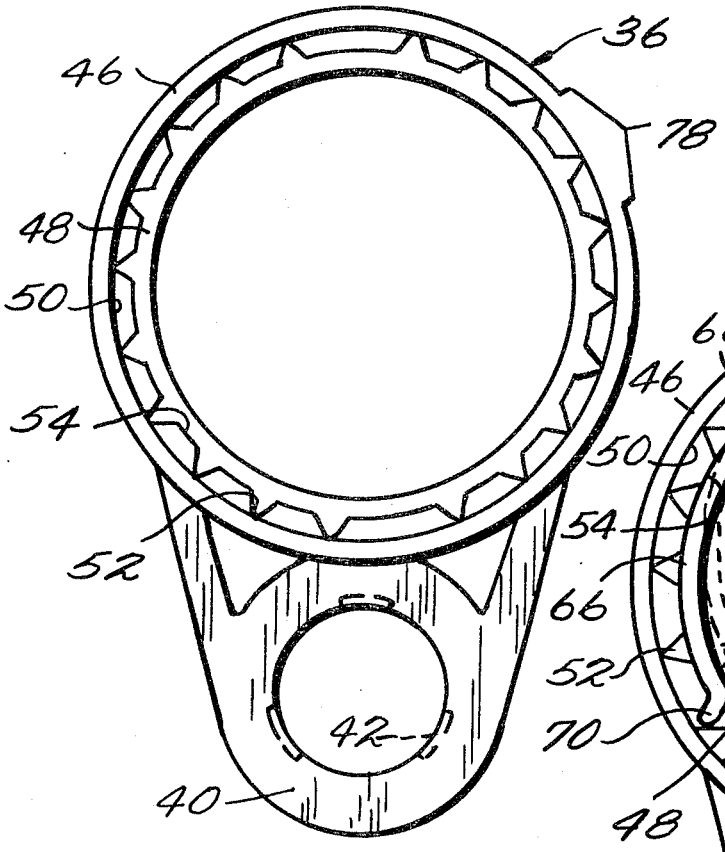
FIG. 5 is a rear elevational view of the arm member of the adjustable dial assembly.

Referring now more particularly to the drawings, there is shown in FIG. 1 thereof an oscillatory sprinkler, generally indicated at 10, which embodies the principles of the present invention. As shown, the sprinkler 10 includes a housing assembly, generally indicated at 12, carrying a water inlet 14 adapted to be connected with a source of water under pressure. The inlet 14, as shown, is in the form of a female hose coupling which is swivelly carried by a main housing 16 of the housing assembly. The main housing 16 also carries one end of a water discharge tube 18 which is also connected in water pressure communicating relation with the inlet. In accordance with conventional practice, the water discharge tube includes a central upwardly arcuate portion and has its opposite end connected to a fitting 20 fixed to a runner or base 22 forming a part of the housing assembly 12. The water distributing tube 18, in addition to being communicated with the inlet 14, is thus also mounted on the housing assembly 12 for oscillatory movement about a generally horizontally extending axis.

The sprinkler 10 also includes a shaft 24 which extends outwardly from the main housing 16 and is driven by a mechanism within the housing which is operable in response to the flow of water under pressure from the inlet 14 to the water discharge tube 18. The constructional details of the shaft driving mechanism are not fully illustrated in the drawings, since they are entirely conventional. For this purpose the disclosures of the aforesaid three commonly-assigned patents are incorporated by reference into the present specification. Suffice it to say that a water turbine is provided in a position to be turned as the water flows from the inlet 14 to the adjacent end of the water discharge tube 18. The turbine wheel has an integral upstanding worm gear 26 formed thereon which meshes with the periphery of a gear 28 fixed to the shaft 24.

Mounted on the outer end of the shaft 24 exteriorly of the housing 16 is an arm 30 which, as shown, is pivotally connected at one end to a motion transmitting link 32. It will be understood that in lieu of the pivotal connection of the link 32 to the arm 30, the link may be connected to the shaft 24 by a constant velocity cam mechanism of the type disclosed in commonly-assigned U.S. Pat. No. 3,063,646, the disclosure of which is hereby incorporated by reference into the present application.

Connected between the link 32 and the water discharge tube 18 is an adjustable dial assembly, generally indicated at 34, which embodies the improvements of the present invention. An essential characteristic of the improved adjustable dial assembly 34 is that it is made up of only two pieces, one an arm member, which is generally indicated at 36, and the other a dial member, which is generally indicated at 38. Preferably, both of these members are molded of a suitable plastic material, a preferred embodiment being acetal resin, examples of which are available commercially under the trademarks Celcon ® and Delrin ®.

Figure 6:
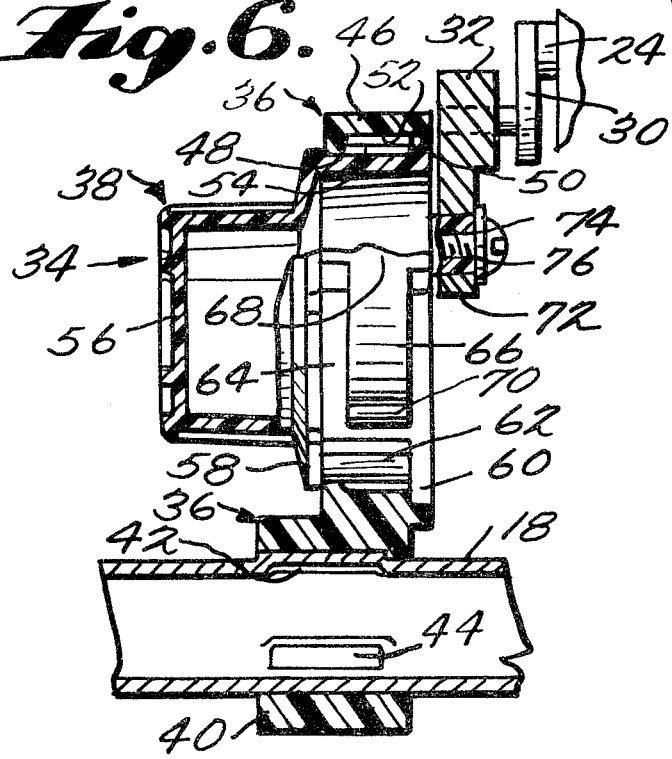
FIG. 6 is a fragmentary side elevational view, partly in section, showing the adjustable dial assembly connected between the motion transmitting link and water discharge tube of the sprinkler.

The arm member 36 includes an annular mounting portion 40 which is of generally cylindrical configuration having an interior periphery of a size to engage the exterior periphery of the end of the water discharge tube 18 mounted within the housing 16. As best shown in FIG. 6, the interior periphery of the mounting portion 40 is formed with a plurality of annularly spaced longitudinally extending grooves 42. As shown, there are three such grooves provided. The grooves serve as a means to fixedly secure the tube 18 to the mounting portion 40. Preferably, the fixed connection is effected by engaging the tube 18 within the mounting portion 40 and then with a suitable tool (not shown) expanding the wall of the tube 18 outwardly as indicated at 44 in FIG. 6 into the space defined by the grooves 42. In this way the deformed projecting portions 44 of the wall of the tube 18 serve as keys to fixedly secure the tube within the annular mounting portion 40.

The arm member 36 also includes a cylindrical portion 46 having its axis disposed in parallel relation with the axis of the mounting portion 40 which, in turn, is coincident with the oscillatory axis of the water discharge tube 18. The interior periphery of the cylindrical portion 46 includes a frustoconical guide surface 48 on one end or side of the cylindrical portion 46 and an annular groove 50 on the opposite end or side thereof. The central section of the interior periphery of the cylindrical portion 46 is formed with a series of radially inwardly facing notches 52 formed in an otherwise uninterrupted cylindrical surface 54. The interior size of the notched cylindrical surface is generally equal to the large internal diameter of the frustoconical surface 48. The notches 52 have a depth extending radially outwardly to a diameter generally equal to the diameter of the surface defining the annular groove 50.

The dial member 38 includes a central hollow cup-shaped knob portion 56, having a flange portion 58 of slightly frustoconical configuration extending outwardly from the rim of the knob portion. The periphery of the flange portion 50 is of a size slightly larger than the small diameter of the frustoconical surface 48 so that when the dial member 38 is moved axially through the cylindrical portion 46 of the arm member 36 the exterior periphery of the flange 58 will engage the frustoconical surface 48 and snap through the same, such through movement being limited by an arcuate flange portion 60 engaging within the annular groove 50.

The arcuate flange 60 has an arcuate extent of approximately 270° and is maintained in spaced relation with respect to the frustoconical flange 58 by an arcuate wall portion 62 extending axially from a position slightly inwardly of the exterior periphery of the frustoconical flange portion to the interior periphery of the arcuate flange. In order to maintain the arcuately spaced ends of the arcuate wall portion 62 and arcuate flange portion 60 in fixed spaced relation, there is provided an axially extending concave reinforcing wall portion 64 between the ends thereof.

Figure 4:
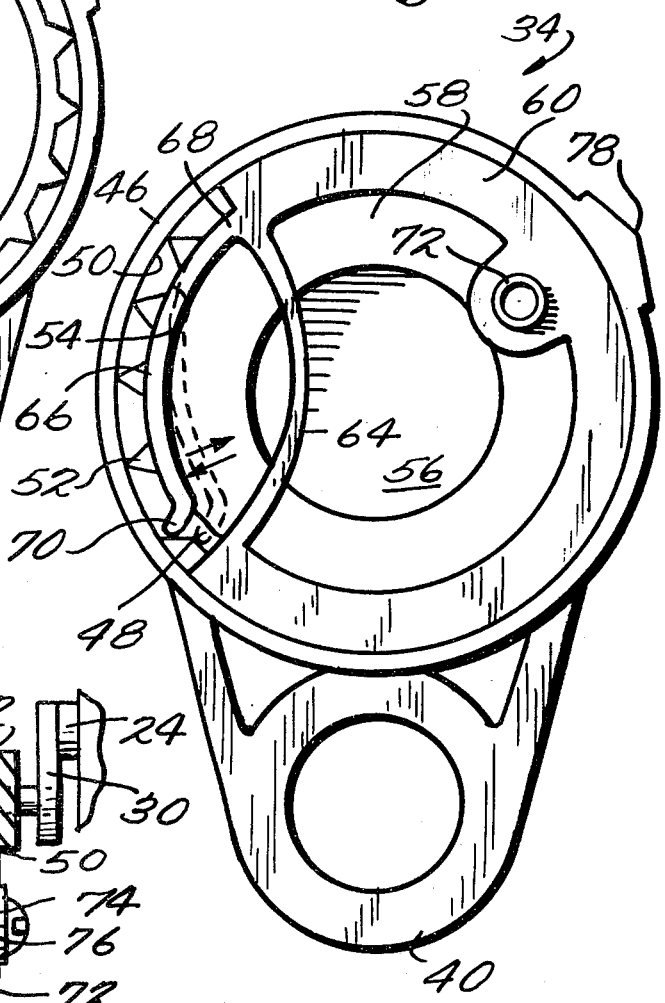
FIG. 4 is a rear elevational view of the improved adjustable dial assembly of the present invention.

Extending within the space disposed radially outwardly of the reinforcing wall portion 64 is a resilient cantilevered latching portion 66. This latching portion is of elongated arcuate shape in elevation and elongated rectangular configuration in section. One end of the latching portion is integrally connected to the dial member, as indicated at 68. The free end thereof is configured, as indicated at 70, to enter the notches 52 and ride over the peripheral surfaces 54 between the notches. It will be understood that the resilient cantilevered latching portion is molded integrally with the dial member in a position such that the end 70 is disposed radially outwardly of the position shown in FIG. 4 a substantial amount so that the position assumed in full lines in FIG. 4 represents a radially inward displacement position in which the latching portion 16 is flexed radially inwardly. It is important to note that the latching portion has a substantial arcuate extent of the order of slightly less than 90°. This permits a substantial resilient displacement of the end 70 to take place providing a highly desirable yieldable securement of the dial member from turning within the arm member.

Finally, it will be noted that the dial member 38 includes an integral cylindrical pivot portion 72 extending axially from the flanged end or side thereof at a position spaced radially from the longitudinal axis of the dial member. As best shown in FIG. 6, the pivot portion 72 is adapted to form the pivotal connection between the dial assembly 34 and the link 32. For this purpose the link is formed with an opening 74 which receives the pivot portion 72 and a headed fastener 76 is suitably mounted within the pivot portion to retain the pivot portion within the opening.

With reference to FIG. 3, it will be noted that the cylindrical portion 46 of the arm member 36 has formed thereon an indicating arrow 78 which forms a cooperating part of indicia on the dial assembly 34 providing a visual indication to the operator as to the position of adjustment of the dial assembly 34. It will be understood that the dial assembly is adapted to be moved into four different positions of operative adjustment in which four different oscillatory cycles of movement are provided. The position shown in FIG. 3 is an intermediate position. One of these operative positions corresponds with a full oscillatory cycle of movement. A second corresponds with an oscillatory movement of smaller amplitude which is symmetrical about a vertical plane passing through the oscillatory axis of the discharge tube 18. The other two oscillatory cycles are identified as left and right respectively, and they are of smaller amplitude and the designation left or right indicating the side of the aforesaid vertical plane on which the cycles of oscillatory movement take place. These four operative positions are designated on the face of the frustoconical flange portion 58 by the words "full", "center", "left" and "right".

It will be understood that included among the series of notches 52 are four notches which correspond with the aforesaid four different oscillatory cycles of movement. In the embodiment shown in the drawings, the dial assembly is structured to be utilized in two different sprinkler models of different size in which the relative angular position of the dial member with respect to the arm member corresponds to the four cycles of movement varies. Consequently, there are different notches of the series provided which correspond with the four oscillatory cycles in each case. In FIG. 3, the periphery of the frustoconical flange is provided with indicia grooves which indicate the selected position when aligned with the arrow 78. As shown, there are four indicating grooves 80 of rectangular cross-sectional configuration which provide indicia of the four oscillatory cycles of movement when the assembly is used in one model. In addition, there are three other semi-circular cross-sectional grooves 82. In this case the square groove 80 indicating the right oscillatory cycle of movement is the same for both models, and the three semicircular grooves 82 indicate the other three positions in the other model. It will be noted that the geometry of the resilient cantilevered latching portion 66 is such that the movement of the dial can be conveniently effected in only one direction and this direction of movement is indicated by arrows 84 on the front face of the knob forming a final portion of the indicia included on the dial assembly.

In operation, when it is desired to select a different one of the four oscillatory cycles of movement, the operator simply manually grasps the knurled exterior of the knob portion 56 of the dial member 38 and turns the dial member in a counter-clockwise direction, as viewed in FIG. 3, until the applicable indicating groove at the selected oscillatory cycle mode is moved into a position of registry with the indicating arrow 78. During such rotational movement, the end 70 of the resilient latching portion 66 rides out of each successive groove 52 and drops into the next successive groove 52. The movement of the end 70 into each groove 52 produces a clicking sound so that in operation the operator both feels and hears the assembly clicking into the selected position of adjustment.

It can thus be seen that the assembly provides for extensive effective operation with an economical simplicity which can only be achieved by providing the simplest number of parts, namely two pieces, both of which are molded of a plastic material.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In an oscillatory sprinkler of the type including a housing assembly having a water inlet for connection with a source of water under pressure, a shaft mounted in said housing assembly for rotation about a generally horizontally extending axis, a water discharge tube mounted in said housing assembly for oscillatory movement about an axis generally parallel to the axis of said shaft and in water pressure communicating relation to said water inlet, means within said housing assembly between said water inlet and said water discharge tube for rotating said shaft in response to the flow of water under pressure from said water inlet to said water discharge tube, a link operatively connected at one end to said shaft in motion transmitting relation thereto, and a two-piece adjustable dial assembly between said link and said water discharge tube for causing the rotational movement of said shaft to be transmitted through said link to said water discharge tube in any selected one of a plurality of different oscillatory cycles of movement, the improvement which comprises said two-piece adjustable dial assembly including an arm member molded of plastic material having a mounting portion fixedly secured to said water discharge tube and a cylindrical portion having an axis disposed parallel to the oscillatory axis of said water discharge tube, and a dial member molded of plastic material extending through the cylindrical portion of said arm member and rotatable with respect thereto about the axis thereof, said dial member having a knob portion at one side of said cylindrical portion manually engageable to effect rotation of said dial member, a pivotal connection with the other end of said link at the other side of said cylindrical portion and an elongated resilient cantilevered latching portion having a free end and an opposite end formed integrally with said dial member, said cylindrical portion having notched surface means receiving the free end of said resilient latching portion for yieldingly retaining said dial member in any selected one of a plurality of positions of rotational movement corresponding to the selected oscillatory cycle of movement.

2. The improvements as defined in claim 1 wherein the knob portion of said dial member is of general cup-shaped configuration having a frustoconical flange portion extending outwardly from the rim thereof.

3. The improvement as defined in claim 2 wherein said dial member includes an arcuate wall portion extending axially from said flange portion radially inwardly from the exterior periphery thereof, said arcuate wall portion having an arcuate flange portion extending radially outwardly from the free end thereof.

4. The improvement as defined in claim 3 wherein said arcuate wall portion and said arcuate flange portion have an arcuate extent of approximately 270° and the arcuately spaced ends thereof are integrally interconnected by a concavely arcuate reinforcing wall portion.

5. The improvement as defined in claim 4 wherein said resilient latching portion extends arcuately radially outwardly of said reinforcing wall portion.

6. The improvement as defined in claim 2, 3, 4, or 5 wherein the cylindrical portion of said arm member includes a frustoconical surface at one side of the interior periphery thereof of a size to permit the exterior periphery of the frustoconical flange portion of said dial member to pass axially therethrough with a snap action when said members are moved axially into assembled relation.

7. The improvement as defined in claim 6 wherein the cylindrical portion of said arm member includes an annular groove in the opposite side of the interior periphery thereof for receiving said arcuate flange portion when said members are in assembled relation.

8. The improvement as defined in claim 7 wherein the cylindrical portion of said arm member includes a central section of the interior periphery thereof between said frustoconical surface and said annular groove, said notched surface means being provided on said central section.

9. The improvement as defined in claim 8 wherein the notched surface means of said central section includes a series of radially inwardly facing notches of a number in excess of the number of different oscillatory cycles of movement to be selected.

10. The improvement as defined in claim 1 wherein said dial member and said arm member have molded therein indicia providing a visual indication of the selected position of rotational movement of said dial member with respect to said arm member.

* * * * *